US006769889B1

(12) United States Patent
Raney et al.

(10) Patent No.: US 6,769,889 B1
(45) Date of Patent: Aug. 3, 2004

(54) BALANCED PRESSURE GEROTOR FUEL PUMP

(75) Inventors: Michael Raymond Raney, Mendon, NY (US); Eugen Maier, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/405,657

(22) Filed: Apr. 2, 2003

(51) Int. Cl.[7] ..... F01C 1/10

(52) U.S. Cl. ..... 418/171; 418/75; 418/79; 418/178; 384/278

(58) Field of Search ..... 418/171, 166, 418/75, 79, 178; 384/278

(56) References Cited

U.S. PATENT DOCUMENTS 2,590,761 A * 3/1952 Edgar ..... 384/278
4,968,233 A * 11/1990 Nakayoshi et al. ..... 418/77
4,978,282 A * 12/1990 Fu et al. ..... 417/360
5,156,540 A * 10/1992 Fernau et al. ..... 418/152
5,472,329 A * 12/1995 Maynard et al. ..... 418/152
5,997,262 A * 12/1999 Finkbeiner et al. ..... 418/171

* cited by examiner

*Primary Examiner*—Thomas Denion
*Assistant Examiner*—Theresa Trieu
(74) *Attorney, Agent, or Firm*—Patrick M. Griffin

(57) ABSTRACT

A gerotor pump for pressurizing gasoline fuel is capable of developing pressures up to 2.0 MPa with good mechanical and volumetric efficiency and satisfying the durability requirements for an automotive fuel pump. The pump has been designed with optimized clearances and by including features that promote the formation of lubricating films of pressurized fuel. Features of the improved pump include the use of a shadow port in the side plate opposite the outlet port to promote balancing of high fuel pressures on the opposite sides of the rotors. Inner and outer rotors have predetermined side clearances with the clearances of the outer rotor being greater than those of the inner rotor in order to promote fuel pressure balance on the sides of the outer rotor. Support of the inner rotor and a drive shaft on a single bushing with bearing sleeves maintains concentricity. Additional features are disclosed.

14 Claims, 2 Drawing Sheets

BALANCED PRESSURE GEROTOR FUEL PUMP

This invention was made with government support under Contract Number DE-SC02-98EE50526 awarded by the Department of Energy. The government has certain rights in the invention.

TECHNICAL FIELD

This invention relates to gerotor fuel pumps and, more particularly, to pumps with pressure balancing of the rotors for reduced wear.

BACKGROUND OF THE INVENTION

Generally in a gerotor pump, a pressure imbalance between a high pressure discharge side of the inner and outer rotors and a low pressure inlet side of the rotors is present, generating forces that tend to tip or bias the rotors against one of the adjacent side plates. This may be acceptable where the pump is used for pressurizing lubricating oil in an engine because the rotors develop hydrodynamic lubricating films which may be adequate to prevent rubbing of the rotors on the side plates and thereby avoid excessive wear.

However, when a gerotor pump is used to pressurize gasoline, the extremely low viscosity of this fluid makes it difficult to establish hydrodynamic lubrication at high outlet pressures. Without this form of lubrication, higher cost material must be used or other more complex lubrication systems would be required in order to prevent excessive wear. Also, high operating pressure increases the internal leakage of the pump and reduces the volumetric efficiency, resulting in an impractical pump for automotive applications as a fuel pump. Operating pressures for gerotor gasoline pumps have accordingly been limited to relatively low pressures, typically below 1.0 MPa.

SUMMARY OF THE INVENTION

The present invention provides a gerotor pump for pressurizing gasoline fuel and capable of developing pressures up to 2.0 MPa with good mechanical and volumetric efficiency and satisfying the durability requirements for an automotive fuel pump. The pump has been designed with optimized clearances and by including features that promote the formation of lubricating films of pressurized fuel.

A feature of the improved pump is the use of a shadow port in the side plate opposite the outlet port and arranged to promote balancing of high fuel pressures on the opposite sides of the rotors.

A further preferred feature is that the inner and outer rotors have predetermined side clearances. The clearances of the outer rotor are greater than those of the inner rotor in order to promote fuel pressure balance on the sides of the outer rotor.

An additional preferred feature is inclusion of a central recess in the side portion opposite to the side which supports a drive shaft and open to a side of the inner rotor surrounding the drive shaft. The recess communicates through a restricted passage with outlet pressure from the adjacent shadow port for assisting force balance on opposite sides of the inner rotor.

Still another preferred feature is that the drive shaft and the inner rotor are both supported by a single bushing mounted in a side portion of the housing. A first bearing sleeve supports the drive shaft in the bushing and a second bearing sleeve supports the inner rotor on an outer diameter of the bushing.

An optional feature is that the bushing extends into a recess in the inner rotor which communicates with the outlet port through restricted clearances between the inner rotor and the side plate which supports the drive shaft and between the bushing and a bearing sleeve in the recess.

An optional additional feature is that a hard coating such as chromium may be applied to the faces of the side plates to minimize wear when the pump is starting, stopping or running at a speed too low to develop a satisfactory hydrodynamic lubricating film.

These and other features and advantages of the invention will be more fully understood from the following description of certain specific embodiments of the invention taken together with the accompanying drawings.

DESCRIPTION OF THE PREFERRED EMBODIMENT

Figure 1:
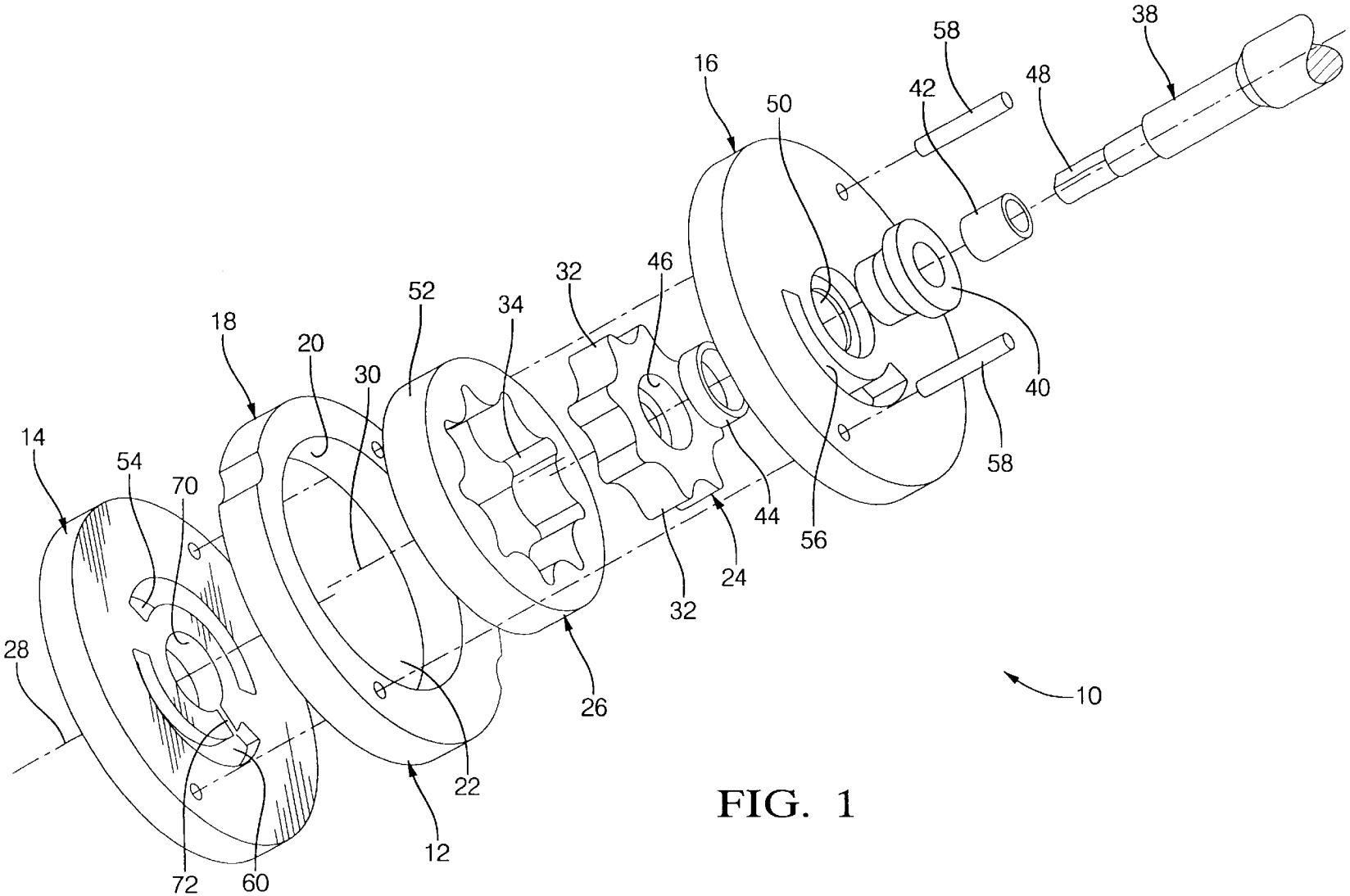
FIG. 1 is an exploded pictorial view showing the assembly and components of a gerotor pump with pressure balancing features according to the invention.
Figure 2:
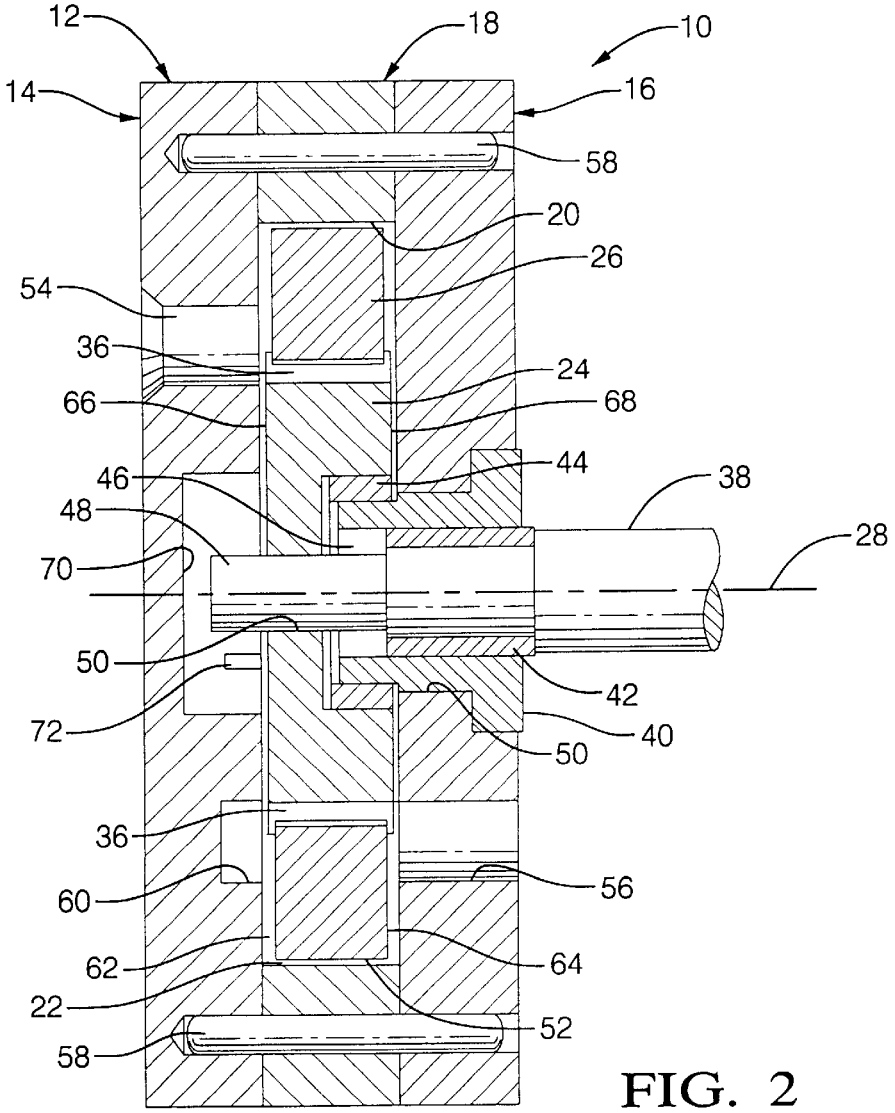
FIG. 2 is a cross-sectional view of the pump assembly of FIG. 1.
Figure 3:
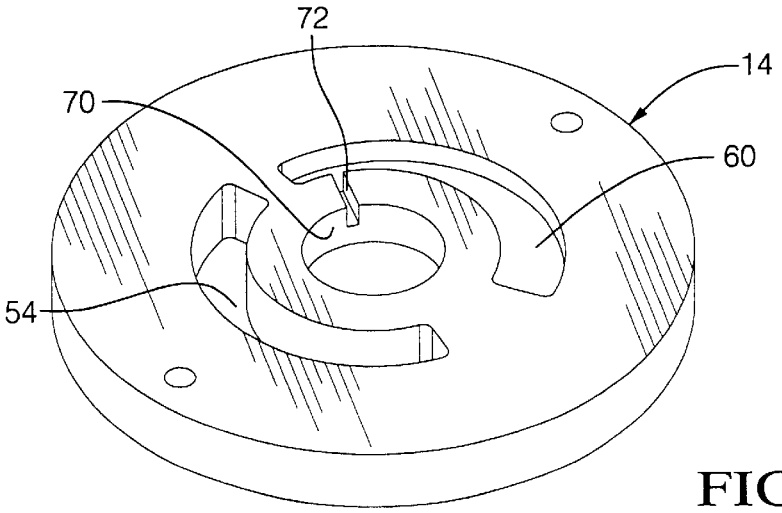
FIG. 3 is a pictorial view better illustrating features of the inlet side plate.

Referring now to the drawings in detail, numeral 10 generally indicates a gerotor fuel pump formed in accordance with the invention. Pump 10 includes a housing 12 including inlet and outlet side plates 14, 16 positioned to close opposite sides of a center plate 18. Center plate 18 defines an eccentric central opening that forms a circular rotor chamber 22 between the side plates. The side and center plates define side and center portions of the pump housing which may be formed other than as separate plates if desired.

Rotatable within the rotor chamber 22 are inner and outer gear rotors 24, 26 that are rotatable within the chamber 22 on eccentric inner and outer rotor axes 28, 30. The inner rotor includes external teeth 32 which engage mating internal tooth recesses 34 to define variable volume pumping chambers 36 between the inner and outer rotors.

A drive shaft 38 extends through and is supported in the outlet side plate 16 by a bushing 40 extending through the plate and partially into the rotor cavity. A shaft bearing sleeve 42 on the drive shaft is rotatably received within the bushing 40 and a rotor bearing sleeve 44 is rotatably received on a projecting inner end of the bushing 40. Sleeve 44 is pressed into a recess 46 in the outlet plate side of the inner rotor. It should be noted that a high wear resistant material such as tungsten carbide is required for the sleeves and bushings since lubricating fluid films are difficult to establish in these small area, high force regions.

The drive shaft 38 has a driving end 48 which engages a through opening 50 in the inner rotor 24 for rotatably driving the inner rotor and, by engagement therewith, the outer rotor 26 also. The outer rotor 26 includes a circular peripheral edge 52 which is rotatable proximate and in opposition to the inner periphery of the central opening 20 which forms the rotor chamber 22.

The inlet side plate 14 includes a generally arc-shaped inlet port 54 which extends through the plate and communicates with the rotor chamber 22 and the pumping chambers 36 formed between the rotors 24, 26. The inlet port 54 extends arcuately somewhat less than a half-circle, the port 54 connecting with an inlet half of the circular rotor chamber 22.

Similarly, a generally arcuate outlet port 56 extends through the outlet side plate 16 for an angular distance of slightly less than a half-circle. The outlet port 56 connects with an outlet half of the rotor chamber 22, lying opposite to the inlet half connected with the inlet port 54.

Upon assembly, the housing 12 is held together by retainer pins 58 which extend through the outlet side plate 16 and the center plate 18 into the inlet side plate 14 so as to maintain alignment of these components.

In accordance with the invention, a shadow port 60 is recessed into an inner surface of the inlet side plate 14. The shadow port is configured essentially identically in extent and area to the outlet port 56 and is located directly across from the outlet port so as to assist in providing balancing outlet pressure on the side of the outer rotor opposite from the outlet port.

The inner and outer rotors, 28, 30 have pre-established side clearances from opposing sides of the housing side plates 14, 16. The side clearances 62, 64 of the outer rotor are substantially larger than the corresponding side clearances 66, 68 of the inner rotor relative to the adjacent side plates 14, 16. In a particular example for comparison, the side clearances of the outer rotor 26 are approximately fifteen microns (15 $\mu$m) on each side of the rotor while the side clearances of the inner rotor 24 are closer to about ten microns (10 $\mu$m) on each side of the rotor.

The larger clearances provided beside the outer rotor 26 provide high pressure fuel, easier access to opposite sides of the outer rotor from the outlet port 56 and opposite shadow port 60. The high pressure fuel acting oppositely on both sides of the outer rotor 26 provides a balanced pressure which tends to maintain the outer rotor in an axially centered position with equal clearances 62, 64 on either side. The smaller clearances of the inner rotor 24 limit the flow of high pressure fuel into the center drive shaft area of the pump and thereby limit leakage between the pump chambers and through other clearances from the pump housing itself.

To assist in balancing pressures on the inner rotor, a central recess 70 is provided on the interior of the inlet side plate 14 and is open toward the side of the inner rotor 24. A groove, forming a restricted passage 72, extends from the central recess 70 to the shadow port 60 formed in the inlet side plate 14, allowing a restricted flow of high pressure fuel to pass from the shadow port into the central recess 70 for exerting balancing pressure on the inner rotor 24.

On the outlet side of the pump, high pressure fuel from the outlet port 56 may pass through the tighter clearances 66, 68 of the inner rotor 24 and the bearing clearances, not shown, of the rotor bearing sleeve 44 into the end recess 46, formed in the inner rotor 24 and open to the inner side of the outlet side plate 16. The high pressure fuel in the clearances forms a hydrodynamic film upon rotation of the inner rotor and the pressures in the recesses on opposite sides of the inner rotor tend to maintain a pressure balance tending to center the rotor.

In the final assembly of the pump, the housing 12 may be enclosed within a suitable outer housing, not shown, or it may be installed in the form shown within a recess in an engine component in which the pump is intended to operate. In either case, the assembly may further include check valves, not shown, connected to the inlet and outlet ports and arranged to prevent reverse flow of fuel from the outlet port to the inlet port when the fuel system is inoperative.

In operation, rotation of the drive shaft 38 rotates the inner and outer rotors 22, 24 together. Fuel is drawn into the inlet port 54 and into the connected pumping chambers 36 in their orbiting motion in the pump during expansion of the chambers over a phase angle of about 160°. As rotation is continued, the pumping chambers 36 are contracted and force fuel out of these chambers into the outlet port 56. This develops an outlet fuel pressure limited by an external pressure relief valve, not shown, and available for injection into engine cylinders through a suitable fuel injection system.

During pump operation at normal driving speeds, hydrodynamic films are developed between the rotors and the opposing inner sides of the side plates 14, 16. The hydrodynamic films lubricate and support the rotary motion of the rotors spaced, with clearance, away from the side plates. This minimizes the occurrence of wear from rotation of the rotors adjacent to or against the side plates. In addition, the minimized clearances between the inner rotor and the side plates limit the loss of fuel pressure through the smaller rotor clearances and reduce the occurrence of fuel leakage from the pump shaft. Accordingly a high degree of efficiency is obtained while relatively high fuel pressures are developed for use in the injection system.

During starting and stopping conditions of the pump, and possibly during operation at lower speeds, the development of hydrodynamic lubricating films of fuel may not be possible. Accordingly, it may be desirable to provide a hard wear surface by either material selection or by coating the inner surfaces of the side plates to reduce the possibility of excess wear over the life of the pump from the low speed and starting and stopping conditions. The pump rotors themselves are preferably made from materials having high strength and excellent wearing qualities since the rotors in operation rotate constantly in engagement with one another. Accordingly the sides of the rotors would normally not need to be coated with a hardened material, such as chromium, but would work with the chromium plated inner surfaces of the side plates to minimize wear of any of the parts against one another.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A gerotor fuel pump comprising:

a housing including first and second side portions closing opposite sides of a center portion having a central opening that defines a circular rotor chamber between the side portions;

inner and outer gear rotors rotatable within the rotor chamber on eccentric inner and outer rotor axes, the inner rotor having external teeth engaging mating internal tooth recesses of the outer rotor and configured to define a plurality of variable volume pumping chambers between and rotatable with the rotors within the rotor chamber;

a drive shaft extending through and rotatably supported in and by one of the side portions, the drive shaft having a driving end terminating short of the other of the side portions and drivably engaging the inner rotor for rotation on the inner rotor axis, the outer rotor driven by the inner rotor and having a peripheral side rotatable proximate a radially inner side of the circular rotor chamber;

inlet and outlet ports each extending through one of the first and second side portions and communicating with the pumping chambers in expansion and contraction portions, respectively, of their rotational paths within the rotor chamber; and a shadow port open to the rotor chamber in the side portion opposite to that of the outlet port, the shadow port being of similar area and configuration, and opposing the outlet port for balancing high fuel pressures on opposite sides of the rotors.

2. A gerotor fuel pump as in claim 1 wherein the drive shaft and the inner rotor are both supported by a single bushing mounted in said one of the side portions supporting the drive shaft.

3. A gerotor fuel pump as in claim 2 including a shaft bearing sleeve between the bushing and the drive shaft and a rotor bearing sleeve between the bushing and the inner rotor.

4. A gerotor fuel pump as in claim 3 wherein the bushing, shaft bearing sleeve and rotor bearing sleeve comprise a bearing system and are made from a high wear resistant material.

5. A gerotor fuel pump as in claim 4 wherein the high wear resistant material is tungsten carbide.

6. A gerotor fuel pump as in claim 1 wherein the first and second side portions are separate side plates and the central portion is a separate plate fixed between the side plates.

7. A gerotor fuel pump as in claim 6 wherein inlet port and the outlet port are in opposite ones of the side plates.

8. A gerotor fuel pump as in claim 7 wherein the outlet port is in the side plate which supports the drive shaft.

9. A gerotor fuel pump as in claim 8 wherein the bushing extends into a recess in the inner rotor which communicates with the outlet port through restricted clearances between the inner rotor and the side plate which supports the drive shaft and between the bushing and a bearing sleeve in the recess.

10. A gerotor fuel pump as in claim 1 wherein inside faces of the side portions have hard surfaces to minimize wear which may occur at pump starting and stopping or at speeds too slow for development of a hydrodynamic lubricating film of fuel.

11. A gerotor fuel pump comprising:

a housing including first and second side portions closing opposite sides of a center portion having a central opening that defines a circular rotor chamber between the side portions;

inner and outer gear rotors rotatable within the rotor chamber on eccentric inner and outer rotor axes, the inner rotor having external teeth engaging mating internal tooth recesses of the outer rotor and configured to define a plurality of variable volume pumping chambers between and rotatable with the rotors within the rotor chamber;

a drive shaft rotatably supported in one of the side portions and drivably engaging the inner rotor for rotation on the inner rotor axis, the outer rotor driven by the inner rotor and having a peripheral side rotatable proximate a radially inner side of the circular rotor chamber;

inlet and outlet ports each extending through one of the first and second side portions and communicating with the pumping chambers in expansion and contraction portions, respectively, of their rotational paths within the rotor chamber; and a shadow port open to the rotor chamber in the side portion opposite to that of the outlet port, the shadow port being of similar area and configuration, and opposing the outlet port for balancing high fuel pressures on opposite sides of the rotors;

wherein the inner and outer rotors have predetermined side clearances from opposing sides of the housing side portions, the side clearances of the outer rotor being greater than those of the inner rotor to promote fuel pressure balance on opposite sides of the outer rotor while limiting fuel flow between the inner rotor and the side portions.

12. A gerotor fuel pump comprising:

a housing including first and second side portions closing opposite sides of a center portion having a central opening that defines a circular rotor chamber between the side portions;

inner and outer gear rotors rotatable within the rotor chamber on eccentric inner and outer rotor axes, the inner rotor having external teeth engaging mating internal tooth recesses of the outer rotor and configured to define a plurality of variable volume pumping chambers between and rotatable with the rotors within the rotor chamber;

a drive shaft rotatably supported in one of the side portions and drivably engaging the inner rotor for rotation on the inner rotor axis, the outer rotor driven by the inner rotor and having a peripheral side rotatable proximate a radially inner side of the circular rotor chamber;

inlet and outlet ports each extending through one of the first and second side portions and communicating with the pumping chambers in expansion and contraction portions, respectively, of their rotational paths within the rotor chamber; and a shadow port open to the rotor chamber in the side portion opposite to that of the outlet port, the shadow port being of similar area and configuration, and opposing the outlet port for balancing high fuel pressures on opposite sides of the rotors; and a central recess in the side portion opposite to that supporting the drive shaft and open to a side of the inner rotor surrounding the drive shaft, the central recess communicating through a restricted passage with outlet pressure from an adjacent port for assisting force balance on opposite sides of the inner rotor.

13. A gerotor fuel pump as in claim 12 wherein the outlet port is in the side portion supporting the drive shaft and the restricted passage communicates the central recess with the shadow port.

14. A gerotor fuel pump as in claim 13 wherein the inlet and outlet ports extend through opposite side portions of the housing.

* * * * *